US008070510B2

(12) United States Patent
Urano et al.

(10) Patent No.: US 8,070,510 B2
(45) Date of Patent: Dec. 6, 2011

(54) CONNECTOR

(75) Inventors: Kazumi Urano, Makinohara (JP); Toshinori Sakurai, Fujieda (JP); Hiroaki Yamagishi, Fujieda (JP)

(73) Assignee: Yazaki Corporation, Tokyo (JP)

( * ) Notice: Subject to any disclaimer, the term of this patent is extended or adjusted under 35 U.S.C. 154(b) by 43 days.

(21) Appl. No.: 12/839,208

(22) Filed: Jul. 19, 2010

(65) Prior Publication Data

US 2011/0021060 A1 Jan. 27, 2011

(30) Foreign Application Priority Data

Jul. 27, 2009 (JP) ..... P2009-174082

(51) Int. Cl.
*H01R 3/00* (2006.01)

(52) U.S. Cl. ..... 439/489; 439/352

(58) Field of Classification Search ..... 439/489, 439/352

See application file for complete search history.

(56) References Cited

U.S. PATENT DOCUMENTS

| | | | | |
|---|---|---|---|---|
| 5,947,763 | A * | 9/1999 | Alaksin | 439/489 |
| 6,386,898 | B1 * | 5/2002 | Taguchi | 439/352 |
| 6,406,319 | B2 * | 6/2002 | Pederson et al. | 439/352 |
| 6,435,895 | B1 * | 8/2002 | Fink et al. | 439/352 |
| 6,468,104 | B2 * | 10/2002 | Fukase | 439/489 |
| 6,494,732 | B2 * | 12/2002 | Kashiyama et al. | 439/352 |
| 6,544,066 | B2 * | 4/2003 | Fukase | 439/352 |
| 6,908,329 | B2 * | 6/2005 | Kozono et al. | 439/352 |
| 7,404,731 | B2 * | 7/2008 | Lim | 439/489 |
| 2004/0023547 | A1 | 2/2004 | Oka | |

FOREIGN PATENT DOCUMENTS

JP 2004-71288 3/2004

* cited by examiner

*Primary Examiner* — Truc Nguyen

(74) *Attorney, Agent, or Firm* — Finnegan, Henderson, Farabow, Garrett & Dunner, L.L.P.

(57) ABSTRACT

A connector includes a first housing, a second housing and a releaser. The second housing is attached with the first housing. An accommodating part is provided in the first housing. A first projection is provided in the accommodating part. A detector is accommodated in the accommodating part. A lock portion is provided in the detector and is engaged with the first projection. The releaser releases the lock portion from the first projection when the second housing is attached with the first housing.

5 Claims, 12 Drawing Sheets

CONNECTOR

BACKGROUND

The present invention relates to a connector which enables the detection of its fitting condition.

Conventionally, as a connector which enables the detection of a fitting condition of a pair of housings thereof, there has been known a connector which includes a pair of connector housings and a fitting detection member that is built in one of the connector housings (for example, refer to Patent Document 1).

In this connector, a lock arm is provided on one of the connector housing which is elastically deformed towards a deflection space by the other connector housing. An elastic arm is provided on the detection member, and this elastic arm is elastically deformed in association with a deflecting action of the lock arm. In addition, a restriction receiving portion is provided on the elastic arm, and this restriction receiving portion is locked on a locking portion on the one connector housing when the elastic arm is deformed so as to be restricted from being pushed into the deflection space. Then, when the pair of connector housings are properly fitted in or on each other, the elastic arm is elastically restored to its original state in association with the lock arm is restored to its original state, whereby the detection member is allowed to be pushed into the deflection space.

Consequently, in such a state that the pair of connector housings are properly fitted in or on each other, since the detection member can be pushed into the deflection space, the operator can detect that the pair of connector housings are in the proper fitting state.

[Patent Document 1] Japanese Patent Publication Number 2004-71288

In the connector described above, however, since the elastic arm of the detection member extends in a width direction of the detection member so as to project from a width direction of a deflection space as a result of the deflecting action of the lock arm on the one connector housing, the space has had to be ensured to permit the extending action of the elastic arm, calling for enlargement of the connector in size.

SUMMARY

It is therefore an advantage of some aspects of the invention to provide a connector which can detect a fitting condition of a pair of housings and which can suppress the enlargement thereof in size.

According to one aspect of the invention, there is provided a connector, comprising:

a first housing;

a second housing configured to be attached with the first housing;

an accommodating part provided in the first housing;

a first projection provided in the accommodating part;

a detection member accommodated in the accommodating part;

a lock portion provided in the detection member and engaged with the first projection; and a releaser configured to release the lock portion from the first projection when the second housing is attached with the first housing.

The connector may be configured such that: the releaser includes: a contact portion provided in the detection member and configured to come in contact with the second housing when the second housing is inserted into the first housing to be attached thereto; an elastic portion being extendable, provided in the detection member, connected with the lock portion, and configured to hold an engagement between the first projection and the lock portion in a case where the second housing is not attached with the first housing; and a release portion provided in the second housing and configured to release the lock portion from the first projection when the second housing is attached with the first housing.

The connector may further comprise a second projection provided in the accommodating part; and a groove formed on the detection member and engaged with the second projection.

The connector may further comprise: a first restricting portion provided in the accommodating part; and a second restricting portion provided in the detection member and contacting with the first restricting portion so as to be prevent the detection member moving in a direction opposite to a direction in which the second housing is inserted into the first housing.

The connector may further comprise a third projection provided in the accommodating part and configured to engaged with the lock portion when the second housing is attached with the first housing.

DETAILED DESCRIPTION OF EXEMPLIFIED EMBODIMENTS

Figure 1A:
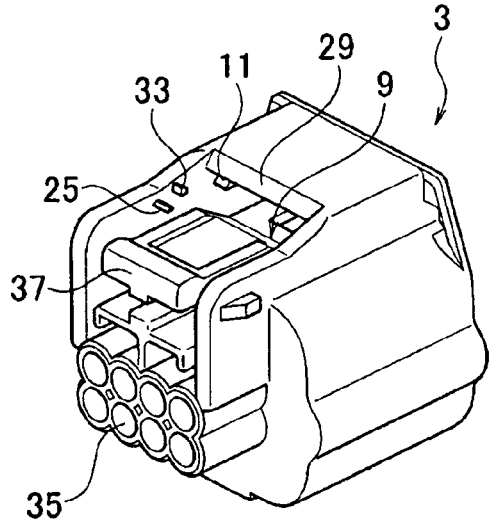
FIG. 1A is a perspective view of a female housing of a connector according to an embodiment of the present invention.

Exemplified embodiments of the invention are described below in detail with reference to the accompanying drawings.

A connector 1 according to this embodiment includes a pair of housings 3, 5 which fit in or on each other and a detection member 7 which is assembled to a female housing 3 (a first housing), which constitutes one of the pair of housings, for detecting a fitting condition of the pair of housings 3, 5. In addition, the female housing 3 includes an accommodating part 9 which defines a space for accommodating the detection member 7. The detection member 7 includes a locking portion 13 which is brought into engagement with a locking projection 11 (a first projection) provided to project within the accommodating part 9 so as to lock the detection member 7 on the female housing 3A.

In addition, a releaser 15 is provided in a male housing 5 (a second housing) constituting the other housing and the detection member 7. This releaser 15 releases the engagement between the locking projections 11 and the locking portion 13 in such a state that the pair of housings 3, 5 are put in a proper fitting state so as to release the locking of the detection member 7 on the female housing 3.

Additionally, the releaser 15 has a contact portion 17, an elastic portion 21 and a release portion 23. The contact portion 17 is provided on the detection member 7 and is brought into abutment with the male housing 5 when the pair of housings 3, 5 are fitted together to thereby move the detection member in an inserting direction in which the male housing 5 is inserted into the female housing 3. The elastic portion 21 is provided to elastically extend between a main body 19 of the detection member 7 and the locking portion 13 and holds the engagement between the locking projections 11 and the locking portion 12 until the pair of housings 3, 5 are eventually in the proper fitting state. The elastic portion 21 is connected with the locking portion 13. The release portion 23 is provided on the male housing 5 and releases the engagement between the locking projections 11 and the locking portion 13 when the pair of housings 3, 5 are eventually in the proper fitting state.

Further, a dislodgement preventive groove 27 (a groove) is provided on the detection member 7. The dislodgement preventive groove 27 is brought into engagement with a dislodgement preventive projection 25 (a second projection) which are provided to project within the accommodating part 9 on the female housing 3 so as to prevent the dislodgement of the detection member 7 from the female housing 3 until the pair of housings 3, 5 are eventually put in the proper fitting state.

Additionally, a movement restricting portion 31 (a first restricting portion) is provided on the detection member 7. This movement restricting portion 31 is brought into abutment with a restricting portion 29 (a second restricting portion) provided on the accommodating part 9 on the female housing 3 to restrict the detection member 7 from moving forwards in the assembling direction in which the detection member 7 is assembled into the female housing 3.

Further, an unlocking holding projection 33 (a third projection) is provided to project within the accommodating part 9 on the female housing 3. The unlocking holding projection 33 is brought into engagement with the locking portion 13 in such a state that the pair of housings 3, 5 are in the proper fitting state so as to hold a state in which the locking of the detection member 7 in the female housing 3 is unlocked or released.

Figure 1B:
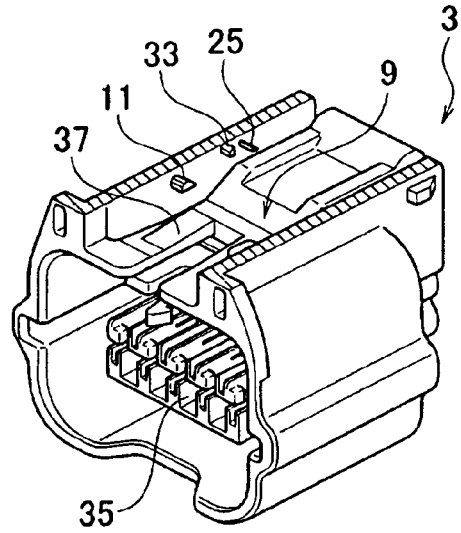
FIG. 1B is another perspective view of the female housing shown in FIG. 1A.
Figure 1C:
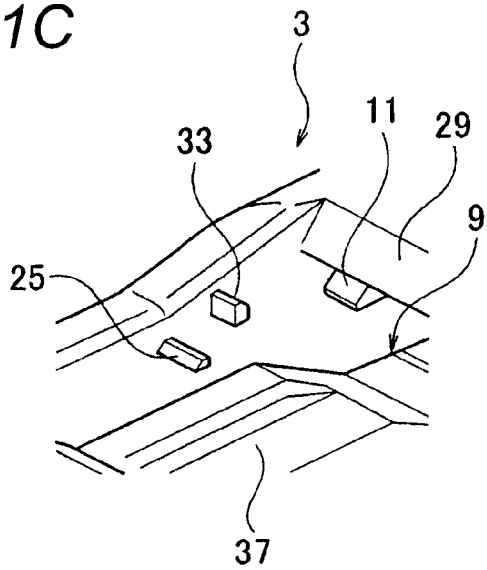
FIG. 1C is an enlarged view of the female housing shown in FIG. 1A.
Figure 2A:
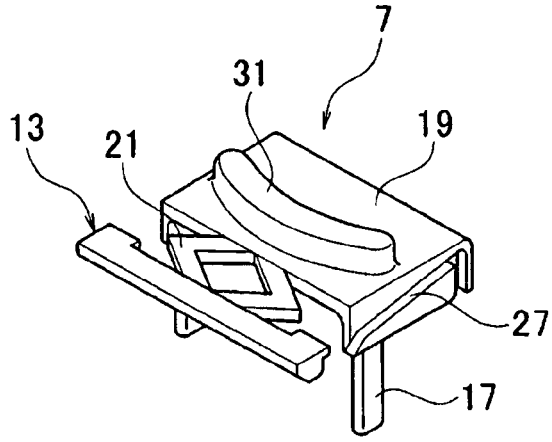
FIGS. 2A to 2C are perspective views of a detection member of the connector according to the embodiment of the present invention.
Figure 2B:
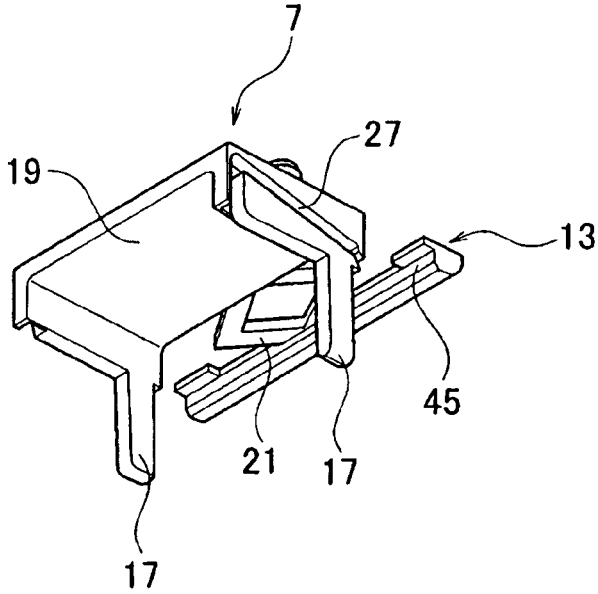
Figure 2C:
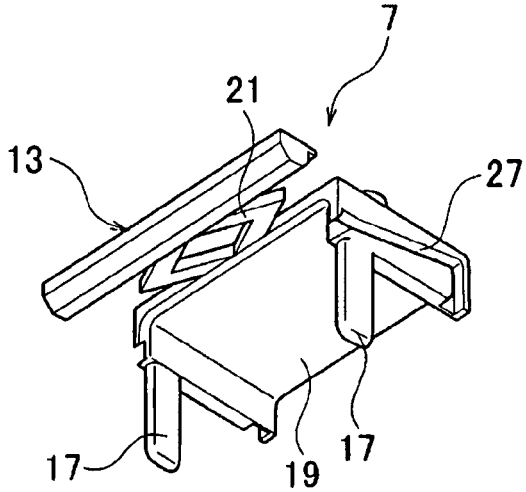
Figure 3A:
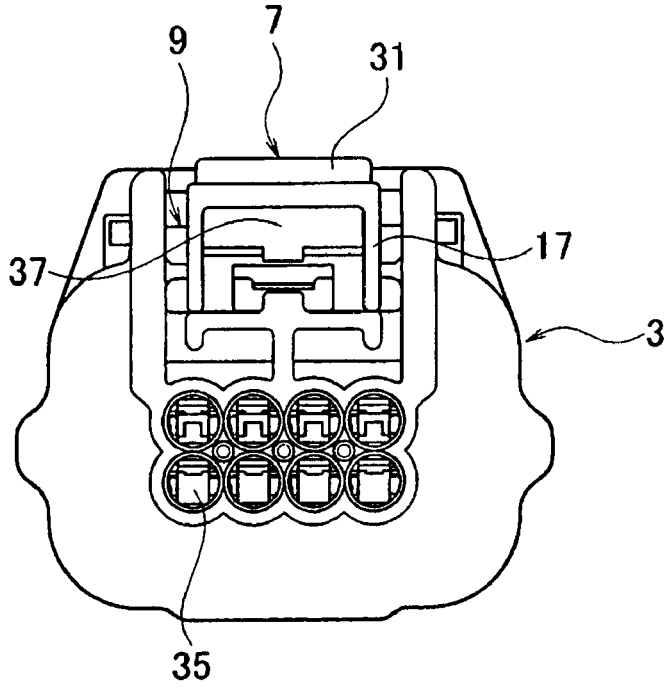
FIG. 3A is a side view showing a state in which the detection member shown in FIG. 2A is assembled on to the female housing shown in FIG. 1A.
Figure 3B:
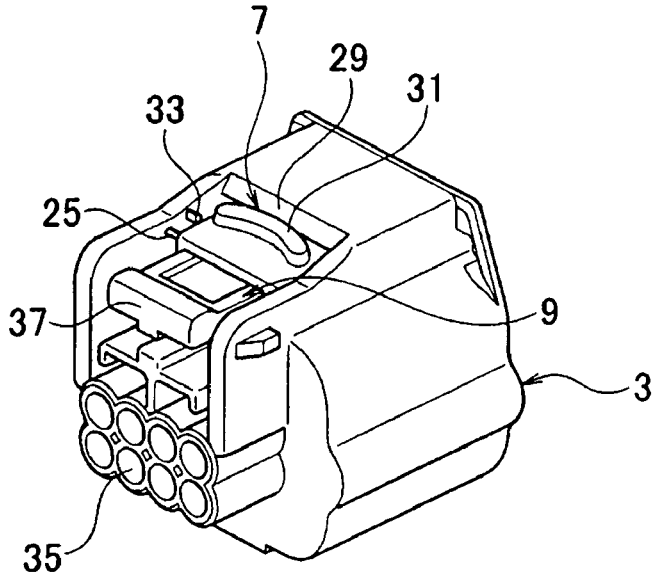
FIG. 3B is a perspective view showing the state shown in FIG. 3A.
Figure 4:
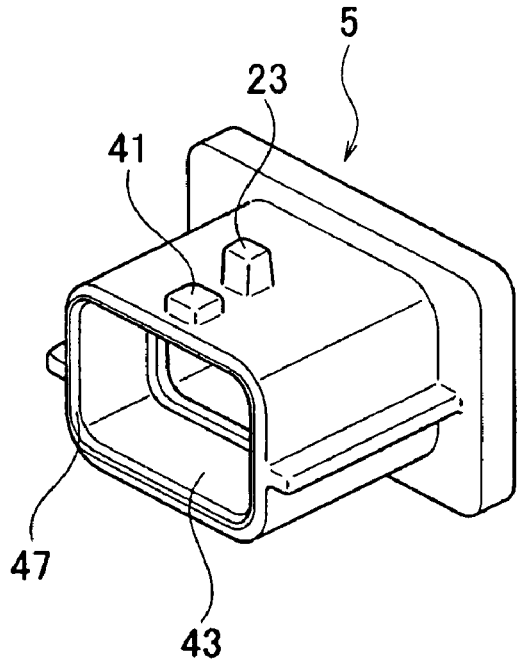
FIG. 4 is a perspective view of a male housing of the connector according to the embodiment of the present invention.
Figure 5:
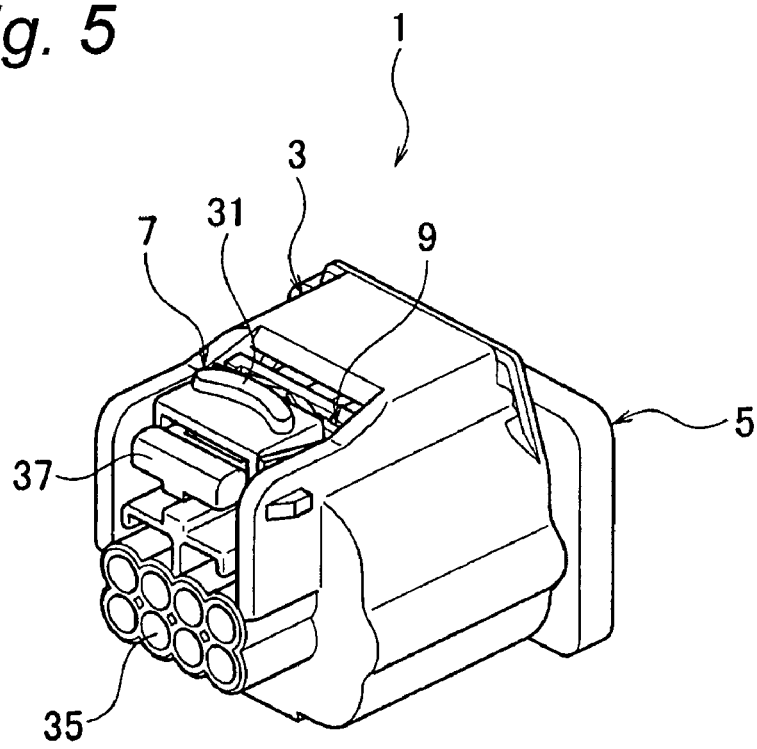
FIG. 5 is a perspective view of the connector according to the embodiment of the present invention.
Figure 6:
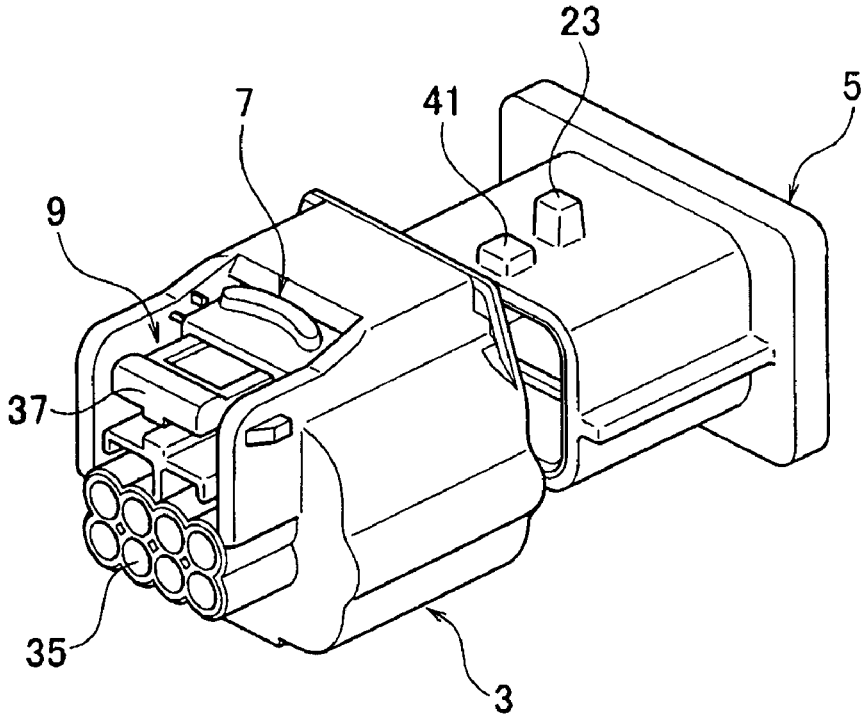
FIG. 6 is a perspective view of the connector shown in FIG. 5 before that the male housing is attached to the female housing.
Figure 7:
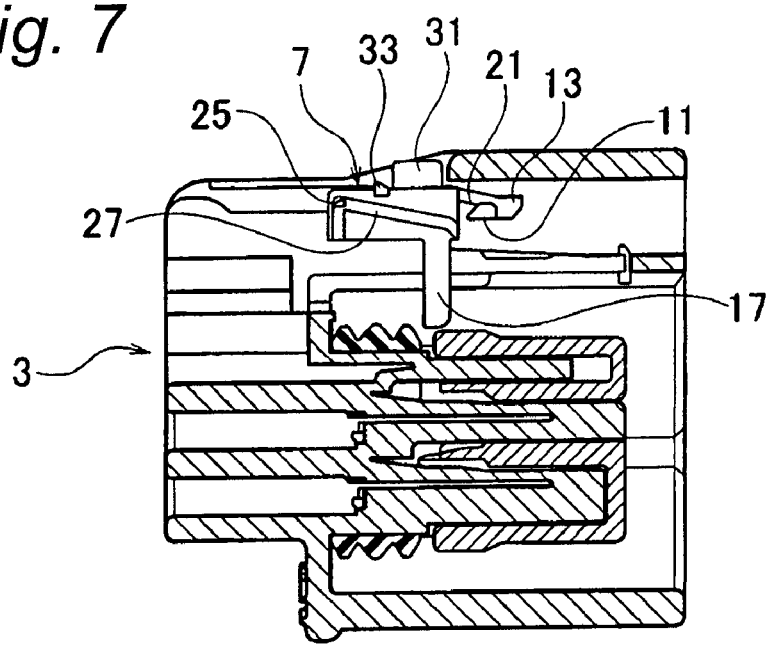
FIG. 7 is a sectional view showing a state in which the detection member is assembled on to the female housing.
Figure 8A:
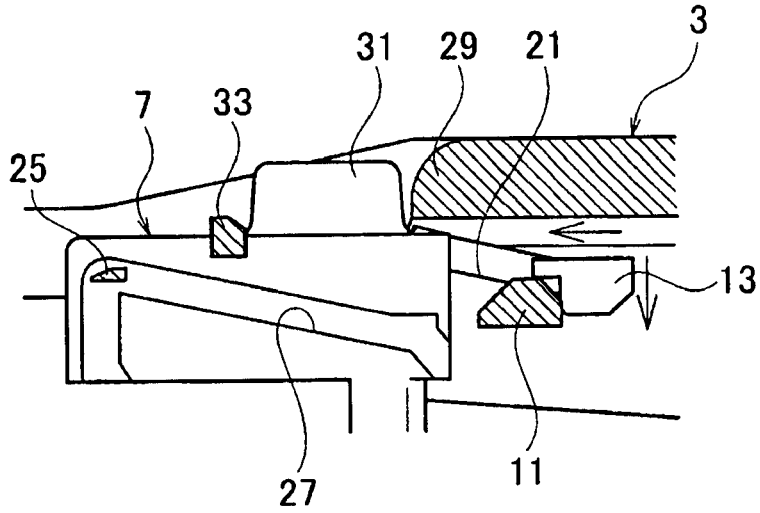
FIG. 8A is an enlarged sectional view of the connector shown in FIG. 5 which shows a state in which the detection member is assembled on to the female housing of the connector.
Figure 8B:
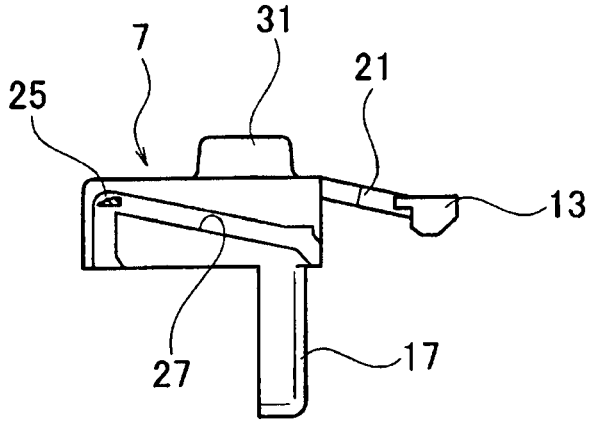
FIG. 8B is an enlarged view of the detection member in the state shown in FIG. 8A.
Figure 8C:
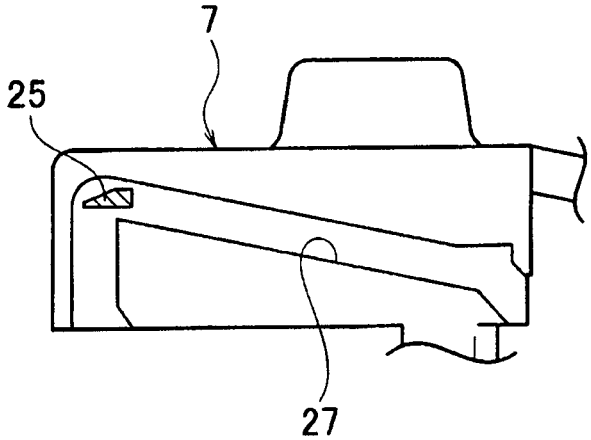
FIG. 8C is an enlarged view of FIG. 8B.
Figure 9:
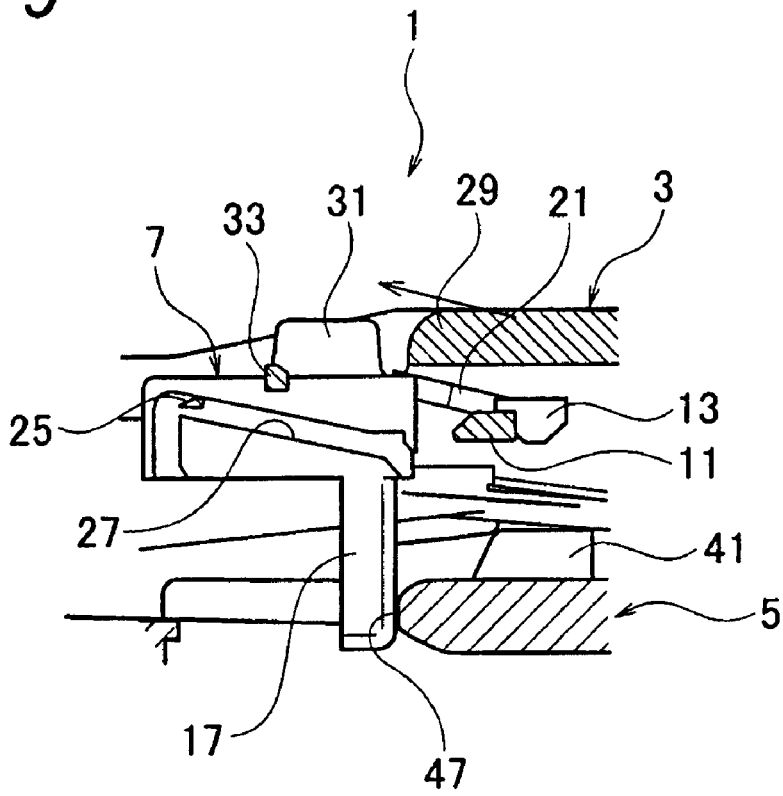
FIG. 9 is an enlarged sectional view of the connector shown in FIG. 5 which shows a state in which the female housing and the male housing are started to be fitted together.
Figure 10:
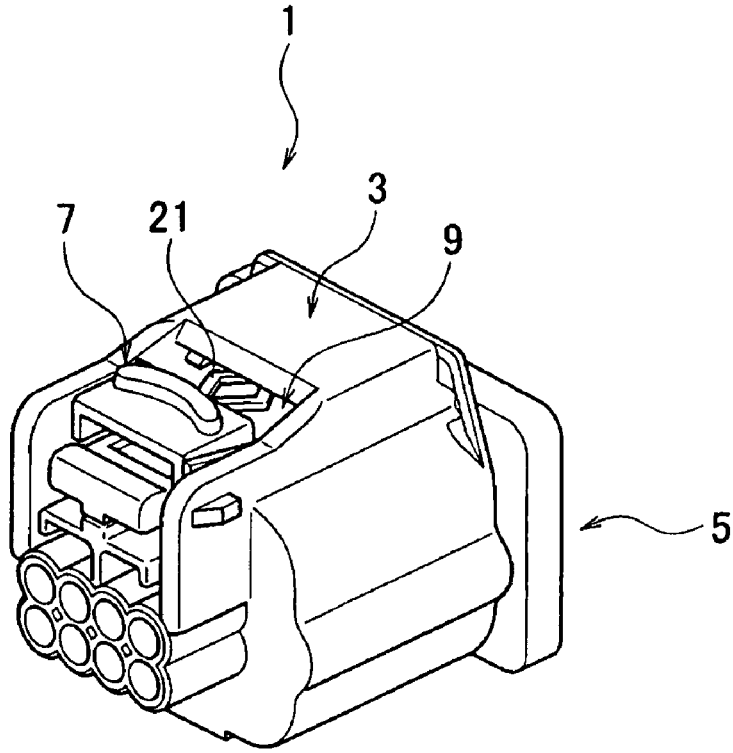
FIG. 10 is a perspective view showing a state in which the female housing and the male housing are in the midst of being fitted together.
Figure 11:
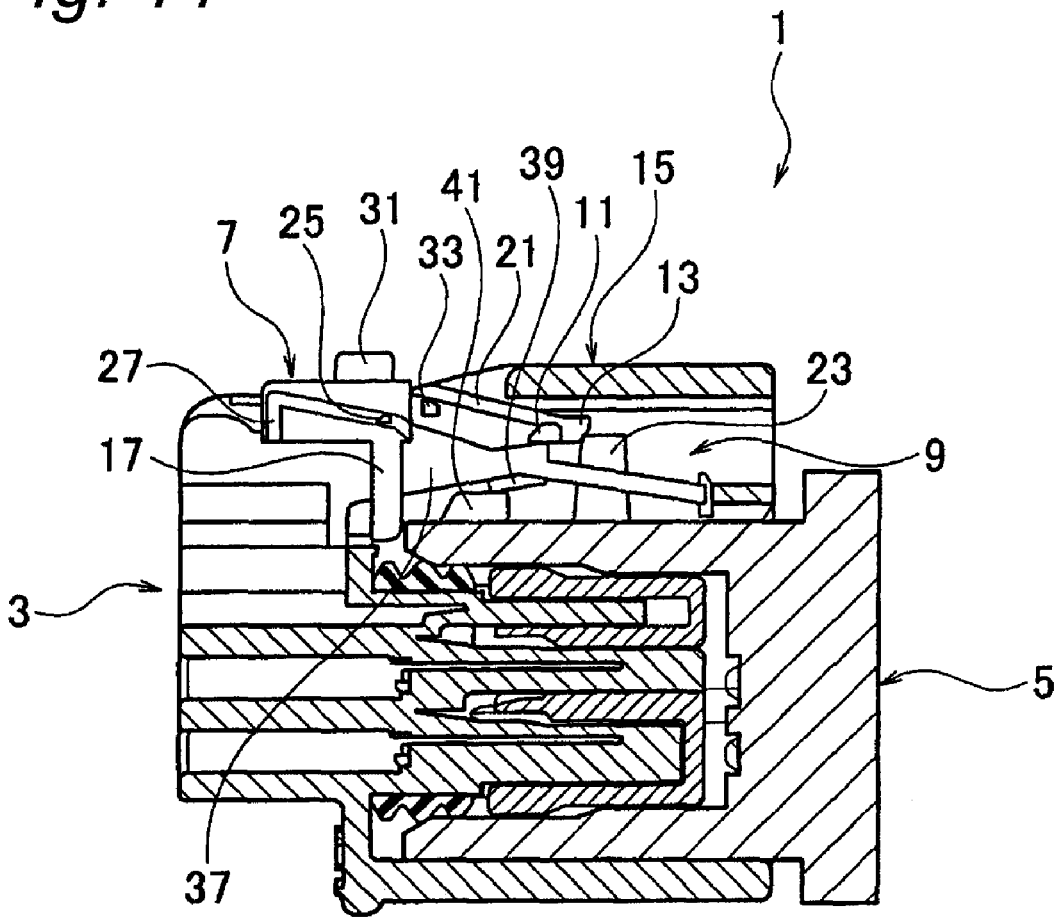
FIG. 11 is a sectional view of the state shown in FIG. 10.
Figure 12A:
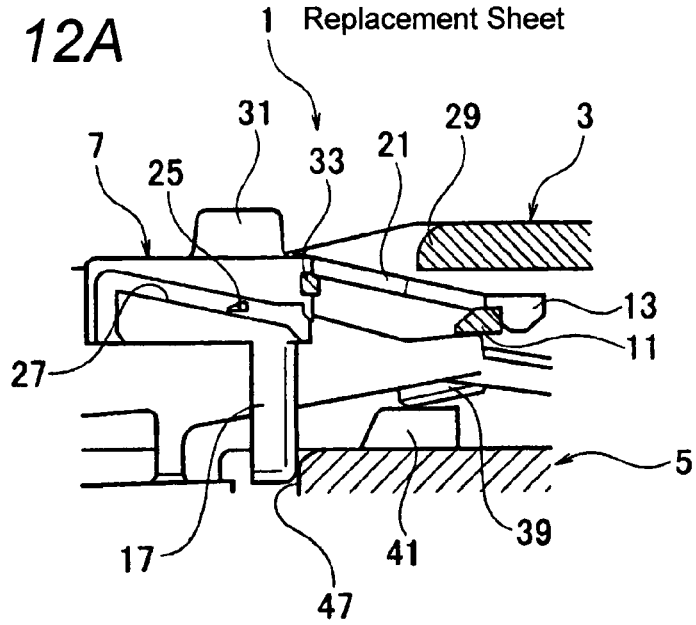
FIG. 12A is a sectional view showing a state in which the female housing and the male housing are in the midst of being fitted together.
Figure 12B:
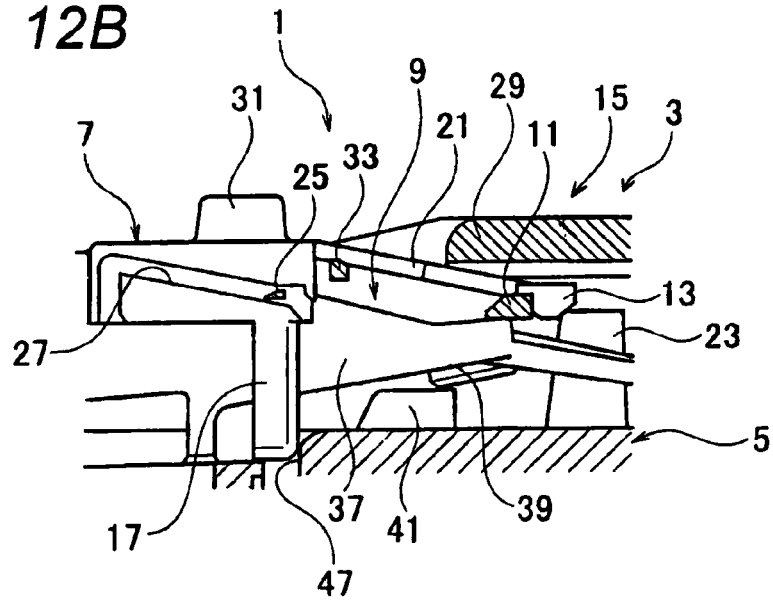
FIG. 12B is a sectional view showing a state in which the fitting of the female housing and the male housing progresses from the state shown in FIG. 12A.
Figure 12C:
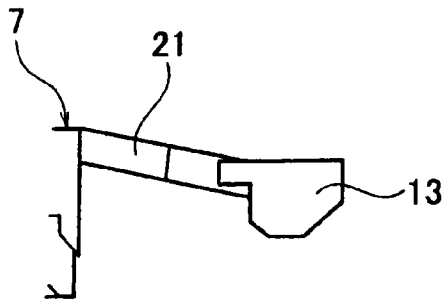
FIG. 12C is an enlarged view of the detection member.
Figure 13:
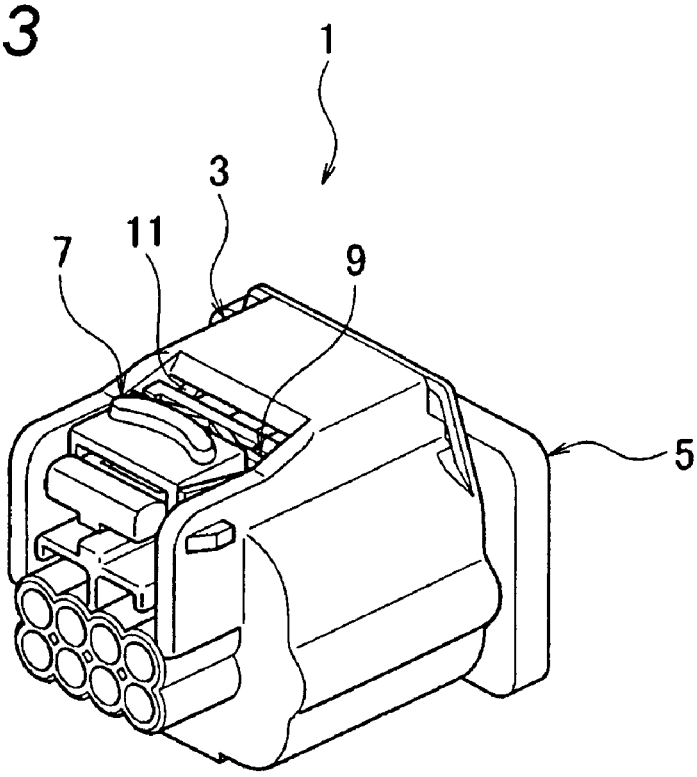
FIG. 13 is a perspective view showing a state in which the fitting of the female housing and the male housing is completed.
Figure 14:
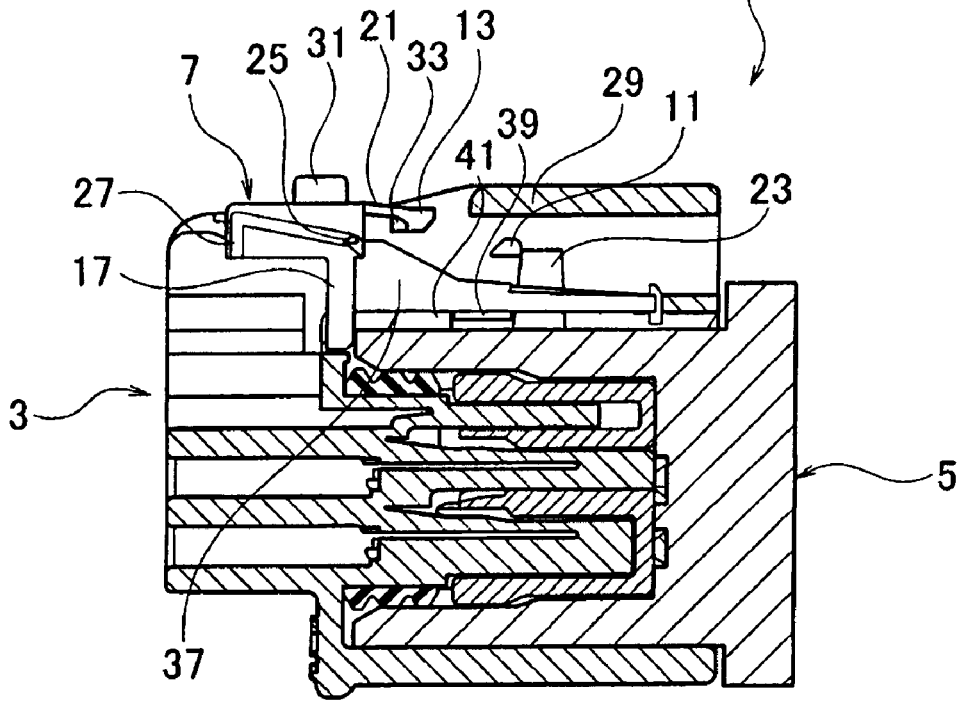
FIG. 14 is a sectional view of the state shown in FIG. 13.
Figure 15A:
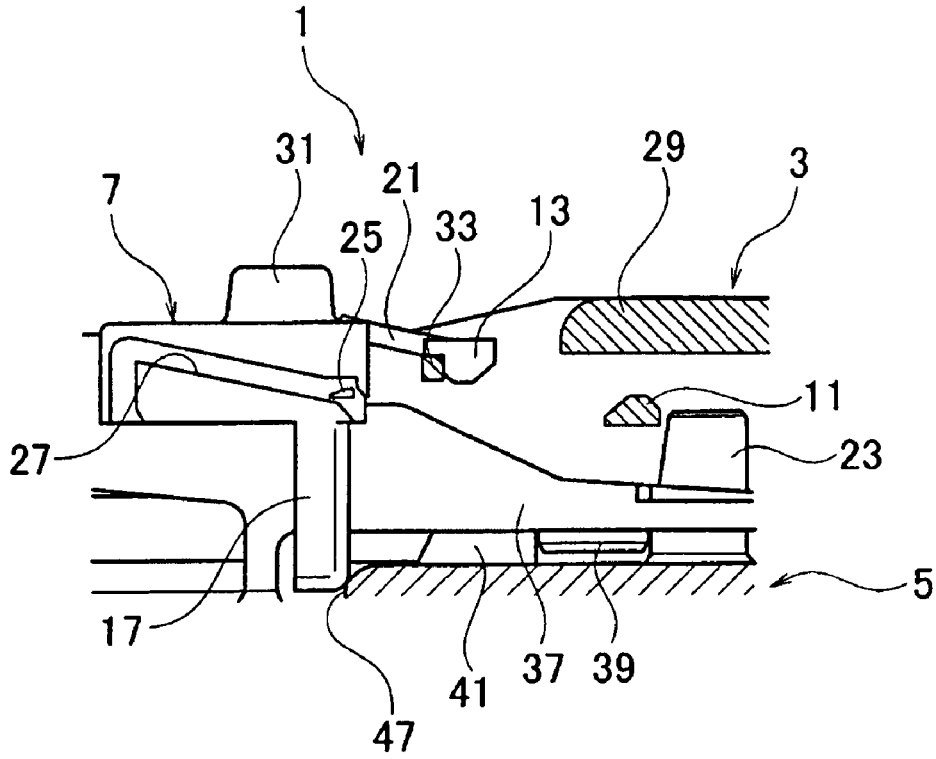
FIG. 15A is an enlarged view of a main part in FIG. 14.
Figure 15B:
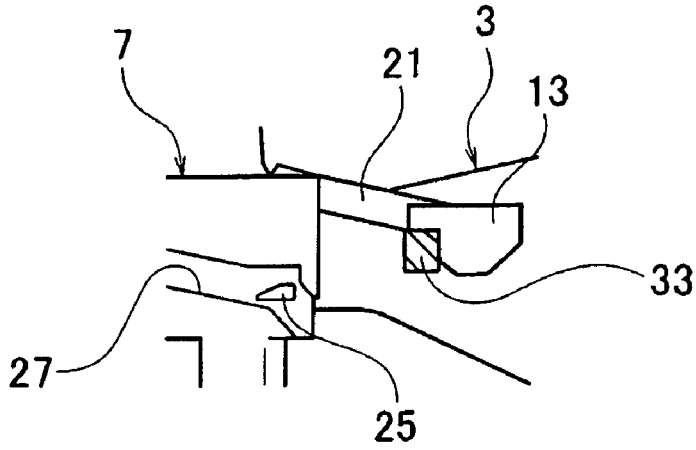
FIG. 15B is an enlarged view of a main part in FIG. 15A.
Figure 16:
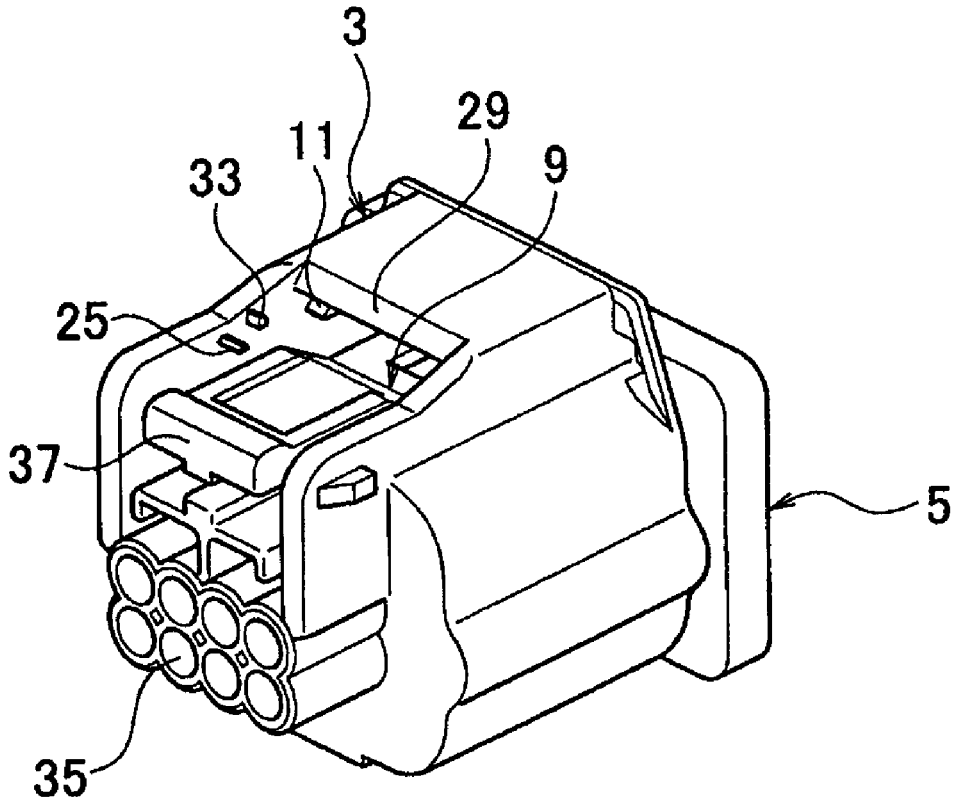
FIG. 16 is a perspective view of the connector shown in FIG. 5 with the detection member removed from the female housing.

As is shown in FIGS. 1 to 16, the female housing 3 is formed into a cylindrical shape and has a plurality of terminal accommodating compartments 35 which are formed in an interior thereof. Terminals (not shown) are accommodated in the plurality of terminal accommodating compartments 35 and the terminals are electrically connected to electric wires (not shown). A lock band portion 37 is provided at an upper portion of the female housing 3 so as to deflect freely. A locking projecting portion 39 is provided at a leading end of the lock band portion 37 so as to project downwards. When the male housing 5 fits thereon, the lock band portion 37 holds the fitting state of the female housing 3 and the male housing 5 by the locking projecting portion 39 being locked on a lock portion 41 on the male housing 5.

The male housing 5 is formed into a cylindrical shape which is smaller in diameter than the female housing 3 and includes a plurality of terminal accommodating compartments 43 which are formed in an interior thereof. Mating terminals (not shown) are accommodated in the plurality of terminal accommodating compartments 43. The mating terminals are electrically connected to electric wires (not shown) and are also electrically connected to the terminals which are accommodated in the female housing 3. A lock portion 41 is provided on an upper side of an outer circumferential portion of the male housing so as to project upwards therefrom. An inclined surface is provided on the lock portion 41 which is inclined in a fitting direction in which the lock portion 41 or the male housing 5 is fitted in the female housing 3. A release portion 23 is provided to the rear of the lock portion 41 in the fitting direction, and a locking recess portion is defined between the lock portion 41 and the release portion 23. When the lock portion 41 fits into the female housing 3, the lock band portion 37 of the female housing 3 is deflected upwards by the inclined surface of the lock portion 41, and the locking projecting portion 39 on the lock band portion 37 is locked in the locking recess portion by the locking projecting portion 39 on the lock band portion 37 riding over the lock portion 41, whereby the lock portion 41 and the lock band portion 37 are put in a locking state.

In the female housing 3 of the pair of housings 3, 5 which fit in or on each other in the way described above, the accommodating part 9 is provided which defines a space portion above the lock band portion 17, and the detection member 7 is assembled into this accommodating part 9 which detects a fitting condition between the pair of housings 3, 5.

The locking portion 13 is provided on the detection member 7. This locking portion 13 is brought into engagement with the locking projections 11 which are provided to project within the accommodating part 9 so as to lock the detection member 7 in the female housing 3. The locking portion 13 is formed into something like a rod which extends in a width direction of the detection member 7. When the detection member 7 is assembled into the accommodating part 9 on the female housing 3, the locking portion 13 moves along inclined surfaces of the locking projections 11 and rides over the locking projections 11 so as to be locked with a locking lock surface 45 hooked on the locking projections 11. An assembled state of the detection member 7 to the female housing 3 is held in an ensured fashion by the engagement between the locking portion 13 and the locking projections 11 from a point in time before the pair of housings 3, 5 are started to be fitted together until a point in time when the pair of housings 3, 5 are eventually put in the proper fitting state. To describe in detail, the detection member 7 is held in an ensured fashion against movements in directions indicated by arrows in FIG. 8A in which the detection member 7 is withdrawn from the accommodating part 9 and the detection member 7 falls downwards, whereby the detection member 7 cannot be removed from the female housing 3. Note that an upward dislodgement of the detection member 7 is prevented by the locking portion 13 and the elastic portion 21 being brought into abutment with an upper wall of the accommodating part 9. The engagement between the locking portion 13 and the locking projections 11 is released by the releaser 15 when the pair of housings 3, 5 are eventually put in the proper fitting state, whereby the detection member 7 can be removed from the female housing 3.

The releaser 15 is made up of the contact portion 17, the elastic portion 21 and the release portion 23. The contact portion 17 are provided on the main body 19 of the detection member 7 so as to project downwards therefrom and are brought into abutment with an end face 47 in the fitting direction of the male housing 5 when the pair of housings 3, 5 are fitted together or, to describe in detail, when the male housing 5 is fitted in the female housing 3 to some extent. By this abutment, the detection member 7 is moved in the inserting direction as indicated by an arrow in FIG. 9 (in a direction in which the detection member 7 is removed from the accommodating chamber 9).

The elastic portion 21 is provided to extend or contract elastically between the main body 19 of the detection member 7 and the locking portion 13 so as to connect the main body 19 and the locking portion 13 together. This elastic portion 21 is extended while holding the engagement between the locking projections 11 and the locking portion 13 until the pair of housings 3, 5 are eventually put in the proper fitting state. Namely, the elastic portion 21 permits the movement of the detection member 7 with the locking projections 11 and the locking portion kept in engagement with each other while the detection member 7 is moved in the inserting direction by the abutment of the contact portion 17 with the male housing 5. Note that the elastic force of the elastic portion 21 is set to such an extent that the engagement between the locking projections 11 and the locking portion 13 is not released when the detection member 7 is moved in the inserting direction.

The release portion 23 is provided to the rear of the lock portion 41 on the male housing 5 in the fitting direction and is formed to project higher than the lock portion 41. This release portion 23 is brought into abutment with an inclined surface formed at the front of the locking portion in the assembling direction (in the direction in which the detection member 7 is inserted into the accommodating part 9) so as to shift the locking portion 13 upwards when the pair of the housings 3, 5 are eventually put in the proper fitting portion or, to describe in detail, when the locking projecting portion 39 on the lock band portion 37 rides over the lock portion 41 so as to be locked in the locking recess portion. The upward shifting of the locking portion 13 releases the engagement between the locking projections 11 and the locking portion 13, and the locking portion 13 is moved in the inserting direction by the contraction of the elastic portion 21. The locking portion 13 which is moved in the inserting direction is then brought into engagement with the unlocking hold projections 33.

The unlocking holding portions 33 are provided to the rear of the locking projections 11 in the assembling direction within the accommodating part 9 of the female housing 3 so as to project inwards. Nothing is provided above the accommodating part 9 in positions where the unlocking holding projections 33 are provided, and the unlocking holding projections 33 are exposed to an exterior space. The unlocking holding projections 33 are brought into engagement with the locking lock surface 45 of the locking portion 13 which is moved in the inserting direction by the contraction of the elastic portion 21 in such a state that the pair of housings 3, 5 are in the proper fitting state so as to hold a state in which the locking of the detection member 7 in the female housing 3 is unlocked or released. The engagement of the unlocking holding projections 33 with the locking portion 13 enables the detection member 7 to be removed from above the accommodating part 9.

The movement restricting portion 31 and the dislodgement preventive grooves 27 are provided on the detection member 7. The movement restricting portion 31 restricts the detection member 7 from moving in a direction opposite to the inserting direction. The dislodgement preventive grooves 27 prevent the detection member 7 from being dislodged from above the accommodating part from a point in time before the pair of housings 3, 5 are fitted together until a point in time when the pair of housings 3, 5 are eventually put in the proper fitting state.

The movement restricting portion 31 is provided on an upper surface of the detection member 7 so as to project therefrom and is brought into abutment with the restricting portion 29 which constitutes an end face in the direction opposite to the inserting direction of the upper side of the accommodating part 9. This movement restricting portion 31 is brought into abutment with the restricting portion 29 in such a state that the detection member 7 is assembled in the female housing 3 or, to describe in detail, in such a state that the locking portion 13 is brought into engagement with the locking projections 11 to thereby restrict the detection member 7 from moving in a direction opposite to the inserting direction, whereby the positioning of the detection member 7 with respect to the female housing 3 is implemented. An initial position of the detection member 7 before the pair of housings 3, 5 are started to be fitted together is held.

The dislodgement preventive grooves 27 are provided on both side surfaces of the detection member 7 and are brought into engagement with the dislodgement preventive projections 25 which are provided to the rear of the unlocking holding projections 33 in the assembling direction within the accommodating part 9 so as to project inwards. The dislodgement preventive grooves 27 are in engagement with the dislodgement preventive projections 25 from a point in time before the pair of housings 3, 5 are fitted together until a point in time when the pair of housings 3, 5 are eventually put in the proper fitting state to thereby prevent the detection member 7 from being dislodged from above the accommodating part 9 until the pair of housings 3, 5 fit in or on each other properly. In addition, the shape of the dislodgement preventive grooves 27 is set to a shape which enables the dislodgement preventive projections 25 to slide therein to be guided so that the detection member 7 takes a posture which facilitates the holding of engagement between the locking projections 11 and the locking portion 13 when the detection member 7 is moved in the inserting direction as a result of abutment of the contact portion 17 of the detection member 7 with the end face 47 of the female housing 5. In addition, front end portions in the assembling direction of the dislodgement preventive grooves 27 are opened so as to be inclined downwards, and the openings at the front end portions of the dislodgement preventive grooves 27 are set so that the dislodgement preventive projections 25 are positioned thereat in such a state that the pair of housings 3, 5 are in the proper fitting state. Because of this, in such a state that the pair of housings 3, 5 are in the proper fitting state, the locking portion 13 of the detection member 7 is brought into engagement with the unlocking holding projections 33, and the dislodgement preventive projections 25 on the female housing 3 are situated at the openings of the dislodgement preventive grooves 27. Therefore, there is provided nothing which prevents an upward movement of the detection member 7, whereby the detection member 7 can be removed from above the accommodating part 9.

A fitting action of the pair of housings 3, 5 and a detecting action of the detection member 7 of the connector 1 configured as has been described heretofore will be described below.

Before the pair of housings 3, 5 are fitted together, the locking portion 13 is in engagement with the locking projections 11, the dislodgement preventive grooves 27 are in engagement with the dislodgement preventive projections 25, and the movement restricting portion 31 is in abutment with the restricting portion 29. As a result, the detection member 7 is restricted from moving opposite to the inserting direction and the dislodgement/falling direction relative to the female housing 3, whereby the detection member 7 cannot be removed from the accommodating part 9. In addition, since the assembled state of the detection member 7 to the female housing 3 can be held in this state, the detection member 7 and the female housing 3 can be handled as a single member.

When the pair of housings 3, 5 are started to be fitted together, the contact portion 17 of the detection member 7 are brought into abutment with the end face 47 of the male housing 5, whereby the detection member 7 is moved in the inserting direction. As this occurs, the elastic portion 21 starts to extend and holds the engagement between the locking portion 13 and the locking projections 11.

In the midst of fitting of the pair of housings 3, 5 (or in the semi-fitting state of the pair of housings 3, 5), the lock band portion 37 is deflected upwards by the lock portion 41, and the locking projecting portion 39 of the lock band portion 37 is situated on the lock portion 47. As this occurs, although the release portion 23 of the male housing 5 is brought into abutment with the locking portion 13 of the detection member 7, since the made housing 5 is not inserted into the female housing 3 sufficiently, the locking portion 13 is not shifted upwards by the release portion 23. Because of this, the engagement between the locking portion 13 and the locking projections 11 is not released, and therefore, the detection member 7 cannot be moved in the inserting direction. In addition, as this occurs, the dislodgement preventive projections 25 are situated in the dislodgement preventive grooves 27, and hence, the detection member 7 is restricted from moving upwards, whereby the detection member 7 cannot be removed from the female housing 3. Consequently, when the pair of housings 3, 5 are in the semi-fitting state (or do not fit in or on each other at all), the detection member 7 cannot be removed from the female housing 3, whereby it can be detected that the pair of housings 3, 5 are not yet in the proper fitting state.

When the pair of housings 3, 5 are in the proper fitting state, the locking projecting portion 39 of the lock band portion 37 rides over the lock portion 41 to thereby be locked in the locking recess portion, whereby the lock portion 41 and the lock band portion 37 are put in a locking state, and the fitting state of the pair of housings 3, 5 is held. As this occurs, the inclined surface formed at the front of the locking portion 13 in the assembling direction is brought into abutment with the release portion 23, and the locking portion 13 is shifted upwards, whereby the engagement between the locking projections 11 and the locking portion 13 is released. The locking portion 13 whose engagement with the locking projections 11 is so released is moved in the inserting direction by virtue of contraction of the elastic portion 21, whereby the locking portion 13 is brought into engagement with the unlocking holding portions 33 which are exposed to the exterior space thereabove. In addition, as this occurs, the dislodgement preventive projections 25 are situated at the openings of the dislodgement preventive grooves 27. In this state, there is nothing which restricts the detection member 7 from moving upwards, whereby the detection member 7 can be removed from the female housing 3, thereby making it possible to detect that the pair of housings 3, 5 are eventually put in the proper fitting state.

In this way, a fitting condition of the pair of housings 3, 5 can be detected based on whether or not the detection member 7 can be removed from the female housing 3, thereby making it possible to prevent an erroneous fitting of the pair of housings 3, 5.

In the connector configured in the way described above, the locking projections 11 and the locking portion 13 are provided within the accommodating part 9 on the female housing 3 and the detection member 7, respectively, so as to lock the detection member 7 on the female housing 3. Therefore, the construction of holding the detection member 7 on to the female housing 3 can be accommodated within the accommodating part 9, and hence, there is no need to provided a space for holding the detection member 7 outside the accommodating part 9.

In addition, the releaser 15 is provided which releases the engagement between the locking projections 11 and the locking portion 13 in such a state that the pair of housings 3, 5 are in the proper fitting state so as to release the locking of the detection member 7 on the female housing 3. Therefore, the detection member 7 can be removed from the female housing 3, whereby it can be detected that the pair of housings 3, 5 are eventually put in the proper fitting state. In addition, in the event that the detection member 7 cannot be removed from the female housing 3, it can be detected that the pair of housings 3, 5 are not yet in the proper fitting state, thereby making it possible to prevent an erroneous fitting of the pair of housings 3, 5.

Further, the fact that the pair of housings 3, 5 are in the proper fitting state can be detected based on whether or not the detection member 7 can be removed from the female housing 3. Therefore, compared with the case in which the fact that the pair of housings 3, 5 are in the proper fitting state is detected based on whether or not the detection member 7 can be attached to the female housing 3, the detection member 7 does not have to perform an expanding action to expand from the accommodating part 9, thereby making it possible to suppress the enlargement in size of the accommodating part 9 and the female housing 3 as a whole.

Consequently, a fitting condition of the pair of housings 3, 5 can be detected based on whether or not the detection member 7 can be removed from the female housing 3. In addition, by accommodating the construction of holding the detection member 7 on to the female housing 3 in the accommodating part, the enlargement in size of the female housing 3 or the connector 1 can be suppressed.

Additionally, the releaser 15 has the contact portion 17, the elastic portion 21 and the release portion 23. Therefore, even though the detection member 7 is moved in the inserting direction as a result of the contact portion 17 being brought into abutment with the male housing 5, the detection member 7 is permitted to move in that way while the engagement between the locking projections 11 and the locking portion 13 is held by virtue of extension of the elastic portion 21 from a point in time when the pair of housings 3, 5 are started to be fitted together until a point in time when the pair of housings 3, 5 are put in the proper fitting state. In addition, when the pair of housings 3, 5 are eventually in the proper fitting state, the engagement between the locking projections 11 and the locking portion 13 can be released by the release portion 23, whereby the detection member 7 can be removed from the female housing 3.

Further, the dislodgement preventive grooves 27 are provided on the detection member 7 which are brought into engagement with the dislodgement preventive projections 25 provided to project within the accommodating part 9 on the female housing 3 so as to prevent the dislodgement of the detection member 7 from the female housing 3 until the pair of housings 3, 5 are eventually in the fitting state. Therefore, the detection member 7 can be prevented from being dislodged from the female housing 3 until the pair of housings 3, 5 are eventually in the proper fitting state, whereby a fitting condition of the pair of housings 3, 5 can be detected by the detection member 7 in an ensured fashion.

In addition, the movement restricting portion 31 is provided on the detection member 7 which is brought into abutment with the restriction portion 29 provided on the accommodating part 9 on the female housing 3 so as to restrict the detection member 7 from moving opposite to the inserting direction in which the second housing 5 is inserted into the female housing 3. Therefore, the detection member 7 can be positioned with respect to the female housing, thereby making it possible to hold the assembled state of the detection member 7 in the female housing 3 in an ensured fashion.

Further, the unlocking holding portions 33 are provided to project within the accommodating part 9 on the female housing 3 which are brought into engagement with the locking portion 13 in such a state that the pair of housings 3, 5 are in the proper fitting state so as to hold the state in which the locking of the detection member 7 in the female housing 3 is unlocked or released. Therefore, the detection member 7 can be removed from the female housing 3 in such a state that the pair of housings 3, 5 are in the proper fitting state.

Note that while the dislodgement preventive projections and the dislodgement preventive grooves are provided on the female housing and the detection member, respectively, in the connector according to the embodiment of the invention, they do not necessarily have to be so provided as long as the accommodating part is configured to cover the detection member from thereabove. As such a construction is actually adopted, since the detection member is covered by the accommodating part, there is no such situation that the detection member is dislodged from above the accommodating part, and hence, the detection member may only have to be pulled out of the female housing 3 from the rear in the assembling direction in such a state that the engagement between the locking projections and the locking portion is released.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

The disclosure of Japanese Patent Applications No. 2009-174082 filed Jul. 27, 2009 including specifications, drawings and claims are incorporated herein by reference in their entirety.

What is claimed is:

1. A connector, comprising:

a first housing;

a second housing configured to be attached with the first housing;

an accommodating part provided in the first housing;

a first projection provided in the accommodating part;

a detector accommodated in the accommodating part;

a lock portion provided in the detector and engaged with the first projection; and a releaser configured to release the lock portion from the first projection when the second housing is attached with the first housing; wherein the releaser includes an elastic portion being extendable, provided in the detector, connected with the lock portion, and configured to hold an engagement between the first projection and the lock portion in a case where the second housing is not attached with the first housing.

2. The connector as set forth in claim 1, wherein the releaser further includes:

a contact portion provided in the detector and configured to come in contact with the second housing when the second housing is inserted into the first housing to be attached thereto; and a release portion provided in the second housing and configured to release the lock portion from the first projection when the second housing is attached with the first housing.

3. The connector as set forth in claim 1, further comprising:

a second projection provided in the accommodating part; and a groove formed on the detector and engaged with the second projection.

4. The connector as set forth in claim 1, further comprising:

a first restricting portion provided in the accommodating part; and a second restricting portion provided in the detector and contacting the first restricting portion so as to prevent the detector moving in a direction opposite to a direction in which the second housing is inserted into the first housing.

5. The connector as set forth in claim 1, further comprising:

a third projection provided in the accommodating part and configured to be engaged with the lock portion when the second housing is attached with the first housing.

* * * * *